United States Patent [19]

Cooper et al.

[11] 4,242,876

[45] Jan. 6, 1981

[54] ROOFTOP TYPE AIR CONDITIONER

[75] Inventors: Edward G. Cooper, Skaneateles; Richard D. Jeffers, North Syracuse; David M. New, Homer, all of N.Y.

[73] Assignee: Carrier Corporation, Syracuse, N.Y.

[21] Appl. No.: 24,357

[22] Filed: Mar. 27, 1979

[51] Int. Cl.[3] ..... F25D 17/06

[52] U.S. Cl. ..... 62/89; 62/DIG. 16; 98/31

[58] Field of Search ..... 98/31; 165/47, 48 R; 62/89, 259, 262, 263, DIG. 16

[56] References Cited

U.S. PATENT DOCUMENTS

| | | | |
|---|---|---|---|
| 3,938,348 | 2/1976 | Rickert | 62/262 |
| 4,139,052 | 2/1979 | Lackey | 62/DIG. 16 |

*Primary Examiner*—Ronald C. Capossela

*Attorney, Agent, or Firm*—J. Raymond Curtin; Robert P. Hayter

[57] ABSTRACT

Air conditioning apparatus and a method of operation thereof, said apparatus being mounted such that the indoor section receives air to be conditioned through an opening in the bottom wall of the unit and likewise discharges the conditioned air into the enclosure to be treated through an opening in the bottom wall of the unit. The heat exchanger, fan and supplementary heaters, if used, are arranged to maximize air flow per given fan power input such that the overall efficiency of the unit can be increased by decreasing the necessary energy to circulate air through the unit. An internal wall is used to support the fan as well as define air flow paths.

7 Claims, 5 Drawing Figures

ROOFTOP TYPE AIR CONDITIONER

BACKGROUND OF THE INVENTION

1. Field of the Invention

The present invention concerns air flow paths through air conditioning units. In particular, the herein described invention pertains to the flow of air through the indoor section of a rooftop type air conditioning unit.

2. Prior Art

Rooftop air conditioning units are known and have been used in the refrigeration industry for a considerable period. Typically a rooftop unit is either a heat pump or an air cooling unit, wherein a dividing wall separates the unit into an indoor section and an outdoor section. The indoor section receives air from the enclosure to be conditioned and discharges conditioned air back into the same area. This air is cooled or heated in a heat exchanger within the indoor section and circulated therethrough typically by a centrifugal fan. Additional heat may be supplied to increase the temperature of this air by means of electrical resistance heat, gas fired heaters or otherwise such that a single rooftop unit may meet all of the heating and cooling needs of the enclosure.

The outdoor section of the unit typically contains the compressors, outdoor heat exchanger and fans adapted to move outdoor air in heat exchange relation with the outdoor heat exchanger. If the unit is capable of reverse cycle operation, four-way valves may also be incorporated within the outdoor section.

Typically there is a closed loop vapor compression refrigeration system wherein refrigerant is increased in temperature and pressure within the compressor and then conducted to a condenser where it discharges heat to the air passing therethrough. This condensor is the indoor heat exchanger when the unit is in the heating mode of operation and the outdoor heat exchanger when the unit is in the cooling mode of operation. The condenser acts to change the state of the refrigerant from a gas to a liquid. The liquid refrigerant is then conducted through an expansion valve where its pressure is decreased such that it will evaporate, absorbing heat in the appropriate heat exchanger. This evaporating heat exchanger is the indoor heat exchanger in the cooling mode of operation and the outdoor heat exchanger in the heating mode of operation. After the liquid refrigerant has been flashed back to a gas, absorbing heat from the air in communication with the particular heat exchanger it is then conducted back to the compressor to complete the refrigeration cycle.

A rooftop type air conditioning unit is one that is typically designed to be mounted to a curb on the top of a building or structure appurtenant thereto. The unit is mounted on the roof to save valuable floor space and to provide a convenient location for service and heat transfer. Since the unit is on the roof the air from the enclosure enters and leaves the indoor section of the unit through the bottom wall of the unit and the roof of the enclosure.

With the present trend towards increasing both the seasonal energy efficiency ratio (SEER) and the coefficient of performance (COP) of air conditioning and heat pump units, it has been found advantageous to provide component arrangement within each section so as to optimize air flow per unit of energy required. Within the indoor section typically a centrifugal fan is mounted to move the indoor air through the unit and discharge same back into the enclosure to be conditioned. The energy requirements of the fan motor detract from the seasonal energy efficiency ratio and the coefficient of performance by utilizing electric energy for other than the direct transfer of heat. Particularly in the cooling mode of operation the energy input to the fan motor is critical since the fan motor is typically mounted within the indoor section and the heat generated by motor operation must be considered part of the load that the unit must cool. Consequently, any design which increases air flow per unit of energy required, results in an increased energy efficiency ratio and increased coefficient of performance. Accordingly, the energy required to produce a given amount of heating and cooling is decreased such that the operating cost to the unit and the amount of precious energy required are reduced.

Previous rooftop units have basically assembled the same components to achieve heating and cooling. It is necessary to have an intake opening to receive air from the enclosure to be conditioned, a heat exchanger to transfer heat between a refrigerant and the air, a fan to circulate the air within the unit, an optional supplemental heat source to provide heat energy to the air external of the refrigeration system and a discharge opening for conducting the air back to the enclosure to be conditioned. FIGS. 3 through 5 herein all show previous arrangements of these components within various commercial units. It can be seen that in these various arrangements the air flow path has been quite convoluted such that it has been necessary to make directional changes and otherwise operate the system with air flow inefficiencies. The herein described invention attempts to combine the components such that the angular change of direction of the air flow occurs within the centrifugal fan and such that the fan location provides for relatively straight draw through access from the heat exchanger and discharge through the supplemental heaters. The centrifugal fan is also located sufficiently far from the heat exchanger that relatively even air flow occurs such that the heat exchanger may operate efficiently over its entire surface. If the centrifugal fan were located very close to the heat exchanger, large volumes of air would be drawn through certain areas of the heat exchanger while other areas would have almost no flow at all.

SUMMARY OF THE INVENTION

It is an object of the present invention to provide an improved rooftop type air conditioning unit.

It is another object of the present invention to provide an air conditioning unit having a more efficient air flow path through the indoor section.

It is a further object of the present invention to locate the various components within the indoor section of the air conditioning unit such that the energy required to move the necessary volume of air through the unit is minimized.

It is a yet further object of the present invention to arrange the components of the indoor section of a rooftop air conditioner such that the energy efficiency ratio and the coefficient of performance of the unit are increased by reducing fan energy necessary to circulate air therethrough.

It is another object of the invention to provide a safe, efficient, reliable and an easy to manufacture air conditioning unit to accomplish the above objects.

Further objects will be apparent from the description to follow and the appended claims.

The above objects are achieved according to the preferred embodiment of the invention which includes an improved air conditioning unit adapted to be mounted on a rooftop having a dividing wall separating the unit into an indoor section with a draw through indoor heat exchanger as a part of the air conditioning circuit, a centrifugal fan and enclosing shroud, a motor for powering the fan and an optional supplementary heater. An outdoor section with an outdoor heat exchanger, outdoor fan and the compressor is also provided. The indoor section of the unit has an indoor air intake opening located in the bottom wall of the closed unit, such that air from the enclosure to be conditioned may enter therethrough, a mounting bracket for securing the indoor heat exchanger between the top and bottom walls of the unit and angled therefrom such that air entering the unit through the indoor air intake opening travels through the heat exchanger, fan brackets as well as an internal wall for securing the centrifugal fan and shroud adjacent the top wall of the unit such that air is drawn from the indoor heat exchanger into the hub of the centrifugal fan and the shroud being secured in a top angular down discharge position, the fan and shroud being located sufficiently distant from the indoor heat exchanger that air may be drawn therethrough to the fan without substantial flow discontinuities, said fan acting to provide most of the angular change direction of the air flow path within the unit, mounting brackets for securing the supplementary heater between the bottom wall of the unit and the discharge of the fan such that air discharge from the fan flows over the supplementary heater, and an indoor air discharge opening in the bottom wall of the unit such that the air being discharged from the fan exits the unit into the enclosure to be conditioned, the direction of flow at discharge being substantially parallel to the direction of flow of indoor air entering the unit.

DETAILED DESCRIPTION OF THE PREFERRED EMBODIMENT

The preferred embodiment as described herein will be to a rooftop air conditioning unit capable of being operated as either an air cooling unit or a heat pump. The particular refrigeration circuits and other structural details not of import to the present invention have been omitted. It is to be understood that the present invention finds like applicability of the other types of apparatus utilizing an in-out air flow through one side of a unit and through a heat exchanger and centrifugal fan. This particular component arrangement to achieve optimum air flow may be utilized in other similar closed units and the disclosure herein is not to be treated as limiting in any manner to only a rooftop air conditioning unit.

Figure 1:
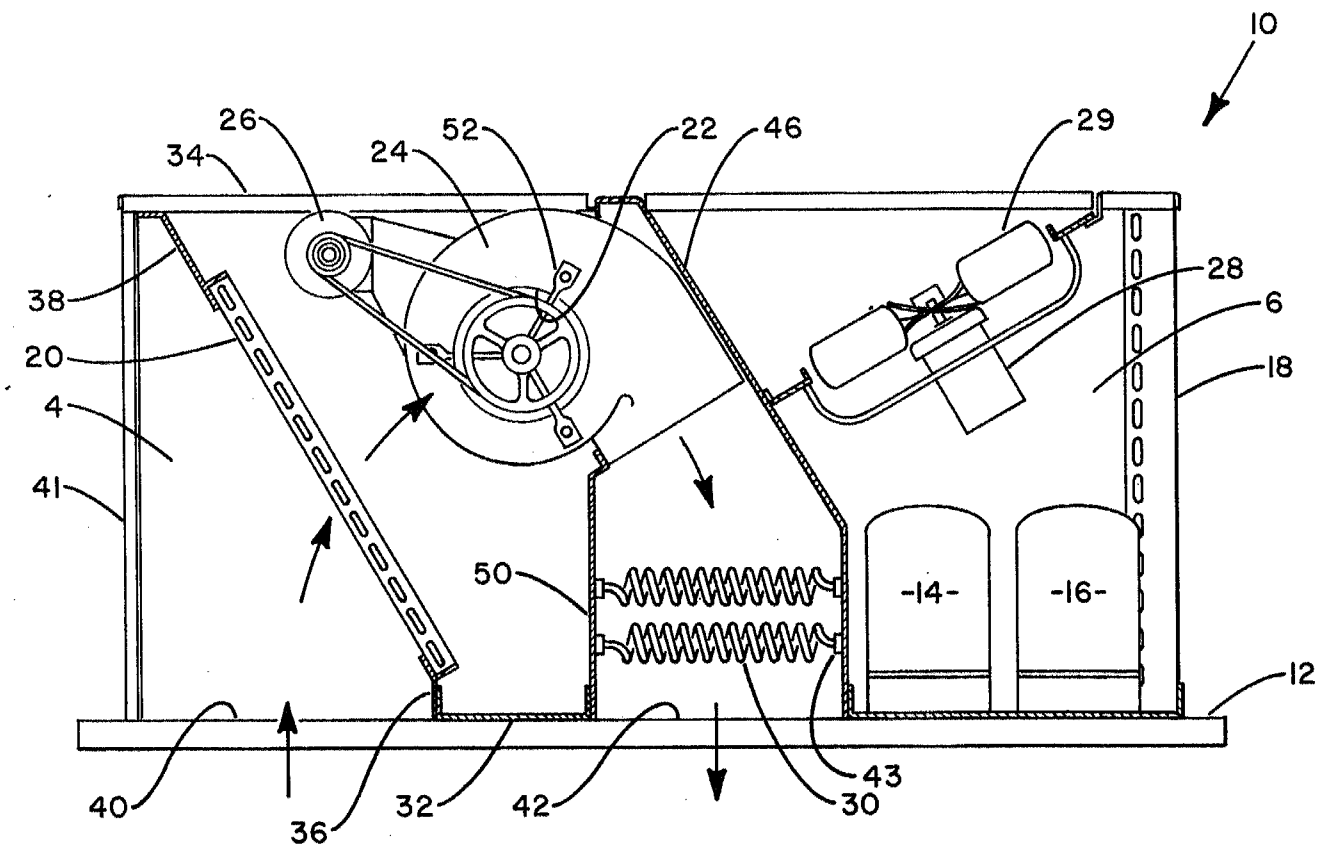
FIG. 1 is a side view of a rooftop air conditioning unit.

Referring now to FIG. 1, there can seen a rooftop air conditioning unit denoted generally by numeral 10. The unit is mounted on curb 12 which is attached to the roof. The unit is divided by dividing wall 46 into indoor section 4 and outdoor section 6. Within outdoor section 6 are mounted the compressors 14 and 16, outdoor heat exchanger 18, outdoor fan motor 28 and outdoor fan 29.

Within indoor section 4, indoor heat exchanger 20 is mounted such that it forms an angle of approximately 60 degrees with the bottom wall 32 of the unit. Mounting brackets 36 and 38 secure opposite ends of the heat exchanger such that it is inclined from bottom wall 32 of the unit towards end wall 41 of the unit and top wall 34. The mounting brackets 36 and 38 further serve to direct incoming air flow through indoor heat exchanger 20. Intake air opening 40 located between mounting bracket 36 and end wall 41 provides access to the unit for the air to be conditioned from the enclosure.

Mounted between the indoor heat exchanger 20 and the dividing wall 46 and adjacent the top wall 34 of the unit is fan 22 and shroud 24. Internal wall 50 further serves to support the fan and shroud. The fan is attached by fan bracket 52 to the shroud such that the centrifugal fan may rotate within the shroud to draw air through the intake opening and through the indoor heat exchanger into the fan shroud. The fan is arranged such that it has a top angular down discharge. Consequently air drawn in through the indoor heat exchanger is forced back out of the fan in a generally downward direction. Consequently the main angular change of direction in the air flow within the unit occurs within the fan shroud. Fan motor 26 is mounted within the indoor section of the unit such that the fan 22 may be driven thereby.

Internal wall 50 extends from bottom wall 32 of the unit to the bottom of fan shroud 24 such that the indoor section for the unit is divided into an incoming air section and an outgoing air section. Supplementary heaters 30 are shown as electrical resistance heaters mounted by brackets 43 between the centrifugal fan discharge and discharge opening 42 in bottom wall 32 of the unit. Discharge opening 42 is located between the internal wall 50 and dividing wall 46 of the unit such that air discharged from the centrifugal fan may pass through the supplementary heaters and exit unit through the discharge opening back into the area to be conditioned. It is to be understood that supplementary heaters 30 are shown as electrical resistance heaters however other heating arrangements may be utilized such as gas or oil fired burners, infra-red heaters or other heating devices.

Figure 2:
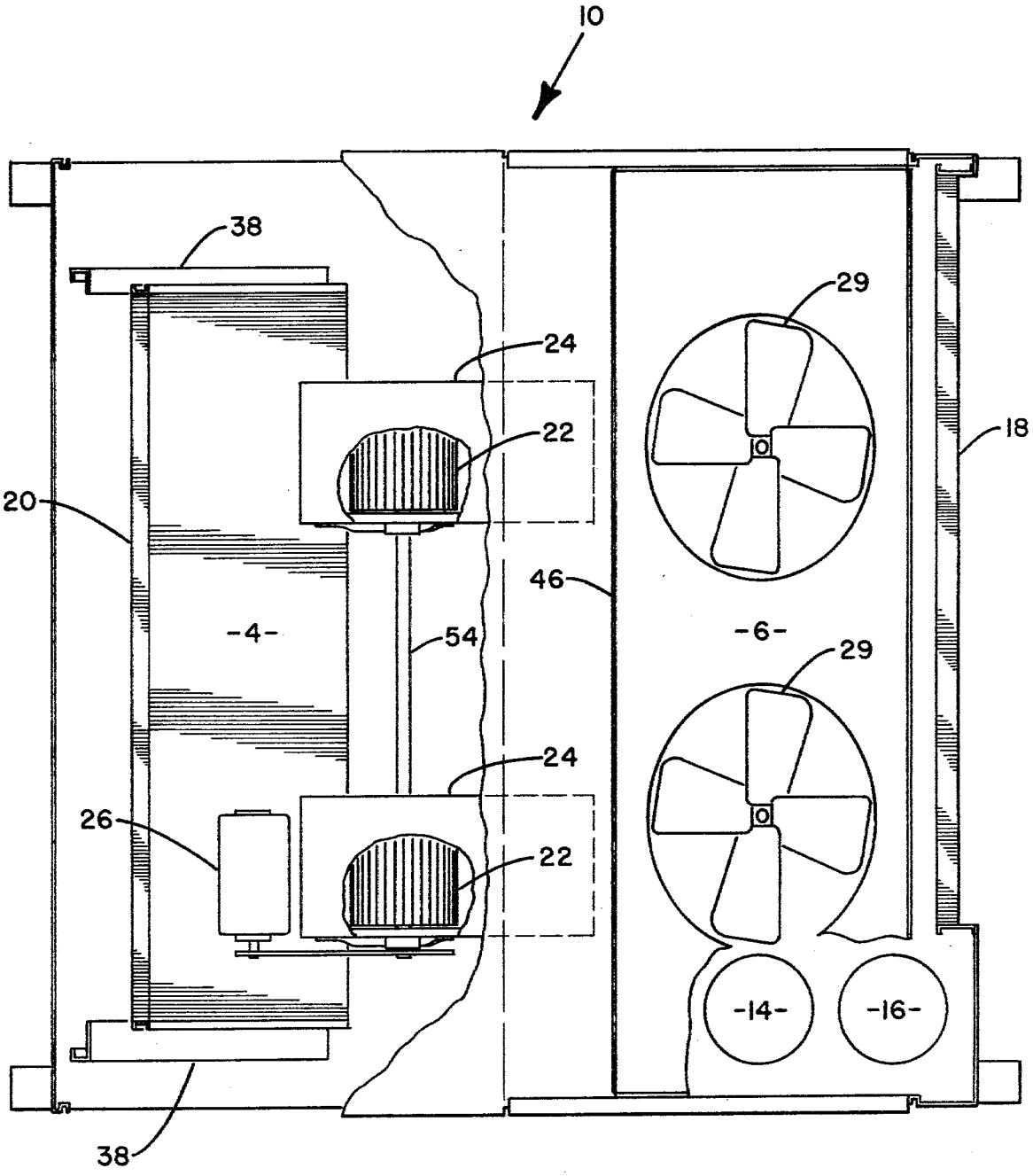
FIG. 2 is a top view of the air conditioning unit shown in FIG. 1.

Referring now to FIG. 2, a top view of the same air conditioning unit, it can be seen that within indoor section 4 of the unit there are mounted two centrifugal fans, each denoted 22. These fans are connected by common drive shaft 54 such that a single fan motor 26 may power both. Location of the indoor heat exchanger 20 and dividing wall 46 are also shown.

The two compressors 14 and 16, outdoor fans 29 and outdoor heat exchanger 18 can be also seen within the outdoor section 6 of FIG. 2.

It will be noted in the preferred embodiment shown in FIG. 1 that the air flow path between intake opening 40 and discharge opening 42 has essentially one main turn. The direction of air flow as shown by the arrow adjacent intake opening 40 and the arrow adjacent discharge opening 42 are generally parallel to each other. The entering air makes a slight turn as it is drawn through the indoor heat exchanger and then makes a major angular direction change within the centrifugal fan. The discharge from the centrifugal fan is mounted at an angle of approximately 30 degrees from the bottom wall of the unit such that the air being discharged therefrom is in a generally downward direction. The discharge of the centrifugal fan is mounted at an angle of approximately 30 degrees from bottom wall 32 of the unit however that it would be effective mounted with an angle between 0 and 50 degrees. The overall air flow path as designed provides for very few flow interruptions, consequently a reduced amount of energy may be utilized to circulate the air therethrough.

It has also been found that the centrifugal fan must be located a sufficient distance from indoor heat exchanger such that air flow through the heat exchanger is relatively smooth and uniform to provide for optimum heat transfer results. If the indoor heat exchanger is located too closely to the centrifugal fan, air flow will be maximized in localized areas and decreased in other areas. Consequently, uneven heat transfer will occur and the entire system will have to work harder to transfer a given amount of heat. By the location of the centrifugal fan herein in respect to the indoor heat exchanger as well as the other components as provided in the system there is sufficient distance between the centrifugal fan and the indoor heat exchanger to provide for relatively uniform heat transfer. Uniform heat transfer minimizes air side pressure drop thereby minimizing indoor fan power consumption.

Figure 3:
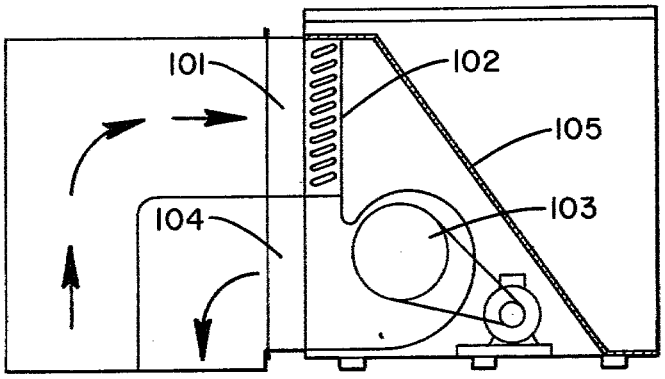
FIG. 3 PRIOR ART
FIG. 3 is a side view of a prior art air conditioning unit.
Figure 4:
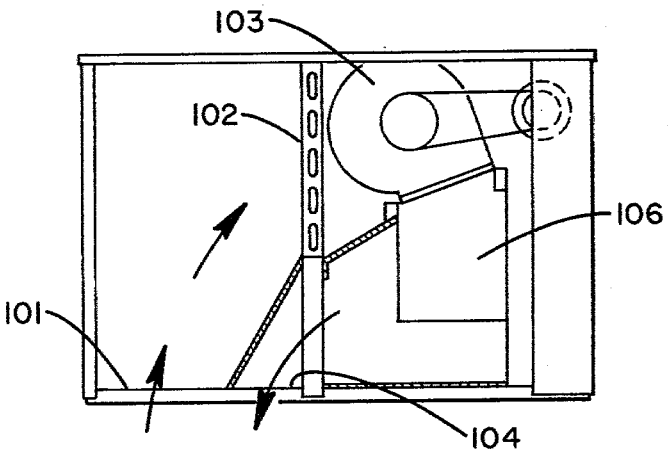
FIG. 4 PRIOR ART
FIG. 4 is a side view of a prior art air conditioning unit.
Figure 5:
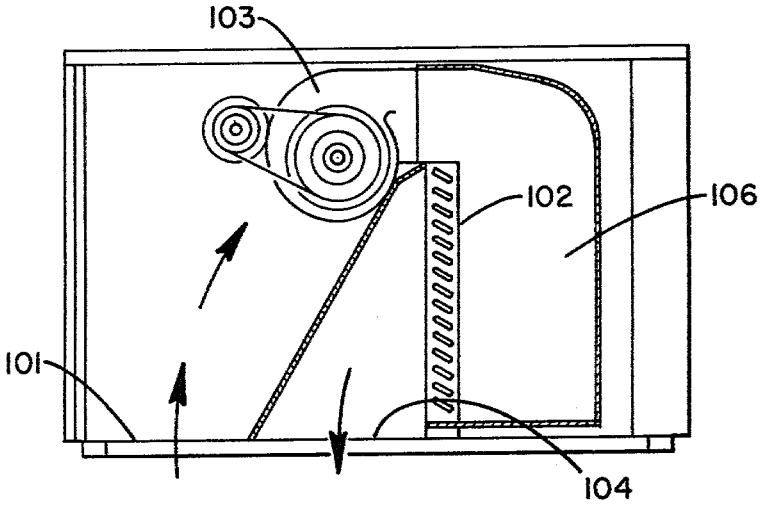
FIG. 5 PRIOR ART
FIG. 5 is a side view of a prior art air conditioning unit.

FIGS. 3, 4 and 5 all show side views of previous rooftop type units showing the relative arrangement of the intake opening, discharge opening, heat exchanger coil, centrifugal fan and supplementary heaters, if used. As can be seen in FIG. 3 (prior art) air enters on the side of the unit, is then drawn through heat exchanger 102 and forced to turn approximately 90 degrees. The air is then drawn into fan 103 and discharged directly out the side of the unit through discharge 104. Dividing wall 105 is shown to indicate which is the indoor section of the unit.

In FIG. 4 (prior art) it can be seen that air enters through intake 101 in the bottom of the unit and then must turn 90 degrees as it is drawn through heat exchanger 102. Centrifugal fan 103 then discharges the air into supplemental heaters 106 and the air must then make another significant change of direction to exit the unit through discharge area 104.

In FIG. 5 (prior art) it can be seen that the air enters the bottom of the unit through intake 101 and then angles to the centrifugal fan 103. The fan then discharges the air and then it travels through roughly a 180 degree angle into the heat exchanger 102 and then makes another angle before it is discharged from the unit through 104.

By comparing the location of the various components as described in the claimed invention to those of the prior art it is obvious that a cleaner, simpler, much more efficient air flow system has been designed. It has been found through testing that it is possible to reduce the necessary fan horse power by 50% while increasing the face area of the indoor coil and the capacity of the unit and the energy efficiency ratio and at the same time not decreasing the indoor fan volume flow rate. Consequently, this improved design allows air conditioning units to be built where an energy reduction of at least 33% solely in the fan power may be accomplished. Additionally, coil face area and SEER may be simultaneously increased without reducing the overall volume flow rate.

The preferred embodiment of the invention has been described herein however it will be apparent to those skilled in the art that variations and modifications can be made within the spirit and scope of the invention.

What is claimed is:

1. A rooftop type air conditioning unit with top, bottom and side walls having a dividing wall separating the unit into an indoor section and an outdoor section having a heat exchanger, an outdoor fan and a compressor, the indoor section having an intake opening in the bottom wall for the receipt of air from the area to be conditioned, an indoor air heat exchanger mounted between the top and bottom walls of the unit at an acute angle, such that entering air flows generally upward therethrough, a centrifugal fan and shroud mounted adjacent to the top wall of the unit on the opposite side of the heat exchanger from the intake such that indoor air may be drawn through the heat exchanger by the fan, said fan being spaced from the heat exchanger to promote efficient air flow therethrough, a discharge opening in the bottom wall of the unit such that air drawn into the fan is accelerated and discharged downwardly therefrom towards the discharge opening to provide a relatively obstacle free and direct air flow path through the indoor section of the unit, the major angular deflection of the air occurring within the fan shroud, and an internal wall which serves to support the centrifugal fan and shroud and which serves to separate air being drawn into the fan from air being discharged from the fan.

2. The apparatus as set forth in claim 1 and further including a supplementary heater located between the fan discharge and the discharge opening in heat exchange relation with the air and further located so as to require no substantial angular air flow changes.

3. The apparatus as set forth in claim 1 wherein the angle between the indoor heat exchanger and the bottom wall of the unit is in the range of 40 degrees to 75 degrees.

4. The apparatuses set forth in claim 1 wherein the angle of the fan discharge to the bottom wall of the unit is in the range of 0 degrees to 50 degrees.

5. An air conditioning unit adapted to be mounted on a rooftop having top, bottom and side walls and a dividing wall separating it into an indoor section with a draw through indoor heat exchanger as a part of the air conditioning circuit, a centrifugal fan and shroud, and at least one supplementary heater, and an outdoor section with an outdoor heat exchanger, an outdoor fan and a compressor; which comprises;

an indoor air intake opening located in the bottom wall of the closed unit such that air from the enclosure to be conditioned may enter therethrough;

mounting means for securing the indoor heat exchanger between the top and bottom walls of the unit and angled therefrom such that the air entering the unit travels through the heat exchanger;

affixing means including an internal wall for securing the centrifugal fan and shroud adjacent to the top wall of the unit such that air is drawn from the indoor heat exchanger into the hub of the centrifugal fan and such shroud being secured in a top angular down discharge position, the fan and shroud being spaced from the indoor heat exchanger to promote even air flow therethrough , said fan acting to provide most of the angular change of direction of the air flow path in the unit;

attaching means for securing the supplementary heater between the bottom wall of the unit and the discharge of the fan such that the air discharged from the fan flows over the supplementary heater; and an indoor air discharge opening in the bottom wall of the unit such that the air being discharged from the fan exits the unit into the enclosure being conditioned, the direction of flow at discharge being substantially parallel to the direction of flow of indoor air entering the unit.

6. A method of reducing the energy required to circulate air through the indoor section of an air conditioning unit including a heat exchanger which comprises:

providing an intake opening in the bottom wall of the unit for directing indoor air therein;

drawing the air through the heat exchanger into a centrifugal fan, the heat exchanger being angled from the bottom wall and the fan being located adjacent the top wall such that air flow is generally upward, said fan furthermore being located sufficiently distant from the heat exchanger for effective even flow therethrough;

discharging the air generally downward from the fan such that the direction of flow of the air is changed within the fan; and guiding the air through a discharge opening in the bottom wall of the unit in a direction roughly parallel to the direction of flow of the incoming air such that the air discharged from the fan flows out of the unit in a relatively straight path.

7. The method as set forth in claim 6 further including the step of:

placing the air discharged from the fan in heat exchange relationship with supplementary heaters without altering the direction of flow between the fan and the discharge opening.

* * * * *